United States Patent [19]

Cazaly et al.

[11] 4,327,531

[45] May 4, 1982

[54] STORAGE TANK CONSTRUCTION

[76] Inventors: Laurence G. Cazaly, 82 Green La., Thornhill, Ontario, Canada, L3T 2A1; Douglas Lamon, 494 Wentworth St. N., Hamilton, Ontario, Canada, L8L 5W9

[21] Appl. No.: 157,566

[22] Filed: Jun. 9, 1980

[30] Foreign Application Priority Data

May 3, 1979 [CA] Canada ..... 326868

[51] Int. Cl.[3] ..... E04H 12/30

[52] U.S. Cl. ..... 52/73; 52/82; 52/194

[58] Field of Search ..... 52/73, 192, 82, 194, 52/741, 745; 220/1, 3, 18; 29/445, 421

[56] References Cited

U.S. PATENT DOCUMENTS

| | | | |
|---|---|---|---|
| 2,036,180 | 3/1936 | McNeil . | |
| 2,899,820 | 8/1959 | Headrick . | |
| 3,073,018 | 1/1963 | Gauthron | 52/73 X |
| 3,866,382 | 2/1975 | Van Tassel | 52/741 |
| 3,895,473 | 7/1975 | Fraser | 52/745 |
| 4,068,419 | 1/1978 | Decoppet | 52/73 X |

FOREIGN PATENT DOCUMENTS

| | | | |
|---|---|---|---|
| 574513 | 9/1977 | U.S.S.R. | 52/194 |

OTHER PUBLICATIONS

"Water Tank" Engineering News-Record, Feb. 14, 1963, p. 69.

*Primary Examiner*—J. Karl Bell

*Attorney, Agent, or Firm*—Moss, Bensette, Thompson, Squires

[57] ABSTRACT

A tower is disclosed for the elevated storage of water or other liquids. The tower includes a concrete cylindrical shell having an upper distal portion, and a steel tank mounted co-axially at the upper distal portion. The tank has a lower floor opening for the shell distal portion to pass therethrough. The shell distal portion has a plurality of peripheral openings adjacent to the tank floor opening. A continuous tank floor passes through the shell peripheral openings, and sealingly closes the tank floor opening. The tank floor supports the tank and liquid therein, and connects the tank to the cylindrical shell.

24 Claims, 10 Drawing Figures

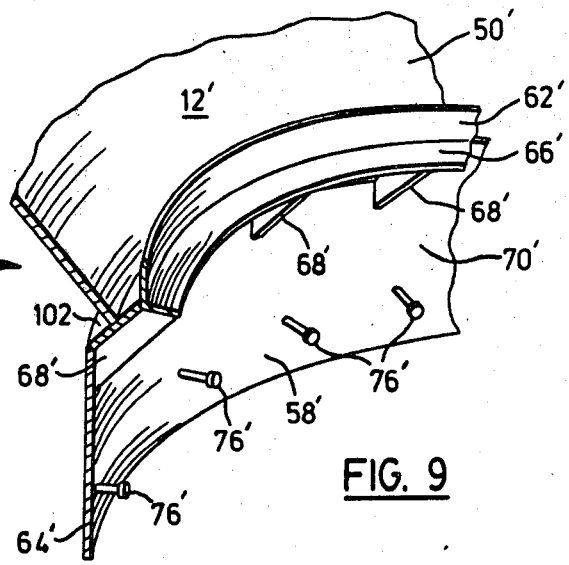
FIG. 9
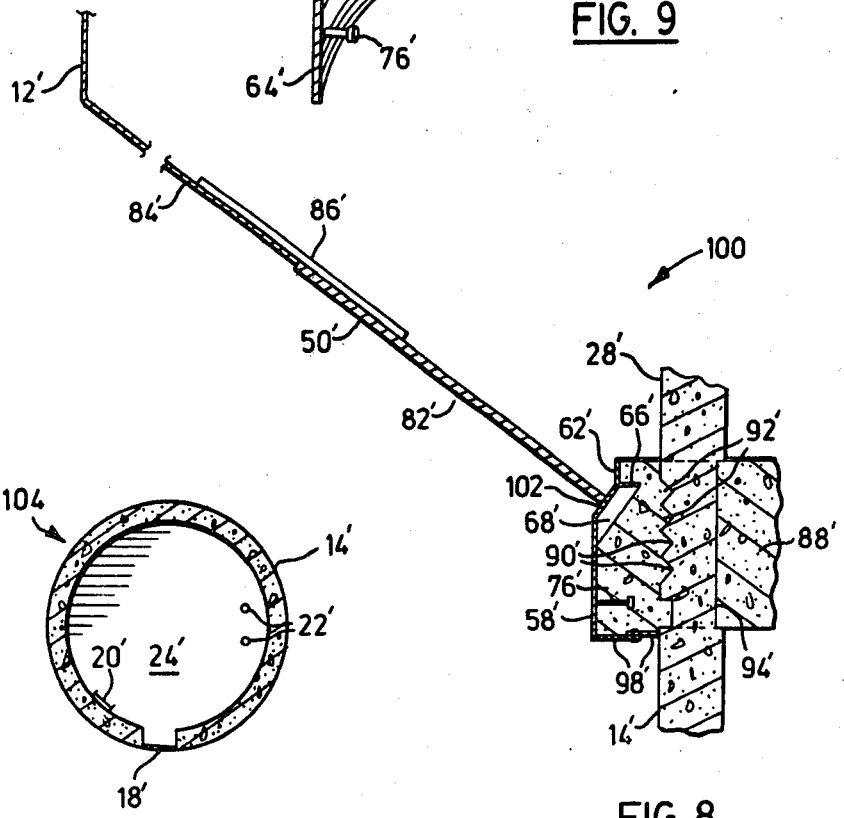
FIG. 10
FIG. 8

STORAGE TANK CONSTRUCTION

This invention relates to elevated storage tanks for storing liquids, and in particular to water storage tanks or towers for maintaining water supplies at a predetermined pressure head.

In the following description, the terms water tower and water storage tank are used interchangeably. Also, it will be appreciated that these tanks or towers may be employed for storing liquids other than water. In any case, the purpose of the tower is to produce a pressure head in the liquid by elevating same.

There are two main desiderata to be considered in constructing elevated storage tanks. On the one hand, it is desirable to minimize costs in order to produce an economical tank. On the other hand, it is desirable to produce a tank having a pleasing appearance. As may be expected, these desiderata are not always compatible in view of the construction materials and techniques presently available.

There are two construction materials commonly used for making these tanks, namely, structural steel and reinforced concrete. It will be apparent to those skilled in the art that each of these materials has its own characteristics and cost factors. Further, the methods of construction used in the past are influenced by the type of material used.

One of the more economical forms of steel water towers produced in the past has consisted of a tank supported by cross-braced, tubular columns. An economical form of concrete tower has been one consisting of a single cylinder. These tanks, however, have generally been considered to be lacking in aesthetic appeal. In order to improve the appearance of these water towers, conical, drum-shaped or bulbous tanks supported by a single cylindrical column have been built in both structural steel and reinforced concrete. However, it is generally not considered to be very economical to construct this type of tower in either material taken separately.

The present invention falls into the category of water towers that is more aesthetically pleasing in appearance, and yet the tower of this invention is economical to construct.

In the present invention, a tower is provided for the elevated storage of liquids, such as water. The tower comprises an upright, hollow, cylindrical shell adapted to be anchored to a supporting base foundation. The shell has an upper distal portion defining a plurality of peripheral openings spaced below the top of the shell. A tank is mounted at the upper distal portion of the shell, the tank having a lower skirt defining a generally vertical opening. The shell distal portion extends through this opening so that the shell peripheral openings are adjacent to the skirt. The skirt includes radially, inwardly projecting anchoring means. Also, a continuous tank floor extends through the shell peripheral openings to the skirt to sealingly close the tank vertical opening, the floor engaging the anchoring means to support and retain the tank in position on the shell.

Preferred embodiments of the invention will now be described, by way of example, with reference to the accompanying drawings, in which:

FIG. 8 is a vertical sectional view, similar to FIG. 5, of a portion of another embodiment of the water tower according to this invention;

FIG. 9 is a perspective view, similar to FIG. 7, of a segment of the lower skirt when viewed from the inside of the embodiment of the tank shown in FIG. 8; and FIG. 10 is a sectional view, similar to FIG. 2, of another embodiment of the tank column according to this invention.

In the following description, like reference numerals will be used throughout to indicate similar elements of the various embodiments described, primed reference numerals being used to distinguish the various embodiments.

Figures 1, 2, 3:
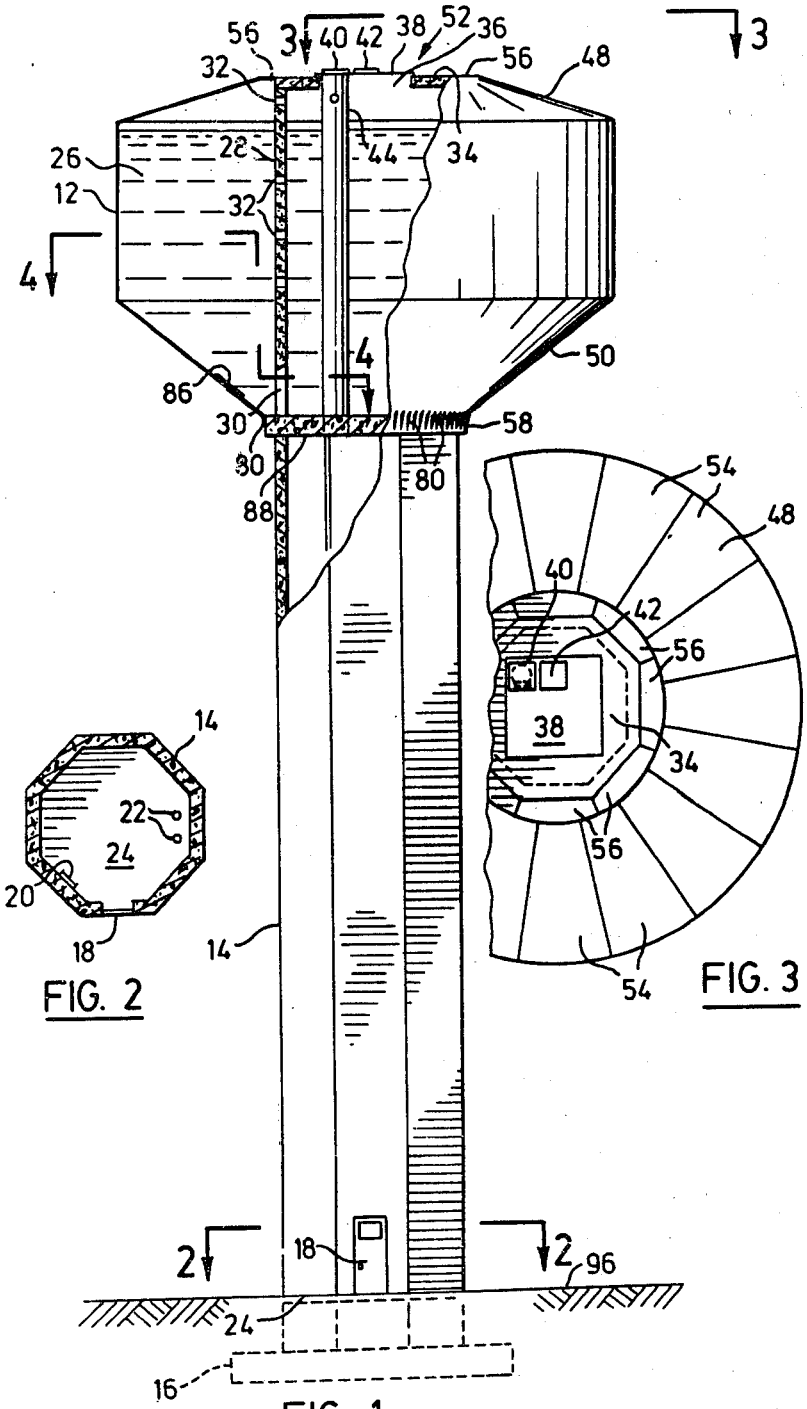
FIG. 1 is a diagrammatic, vertical, elevational view, partly broken away, of a water tower according to the present invention.
FIG. 2 is a sectional view taken along lines 2—2 of FIG. 1.
FIG. 3 is a partial plan view taken along lines 3—3 of FIG. 1.

Referring firstly to FIGS. 1 to 7, a tower for the elevated storage of water or other liquids is generally indicated by reference numeral 10. Tower 10 includes a tank 12 and an upright, hollow, cylindrical column or shell 14. Shell 14 is anchored to a supporting base foundation 16 indicated by dotted lines. Foundation 16 is not considered to be part of the present invention, and therefore, will not be described in detail. However, it will be noted that foundation 16 may be of any suitable type depending upon soil conditions. For example, a concrete slab or spread footing foundation could be used, or a pile type foundation may be required in some locations. In any event, the foundation must be capable of supporting the tower and the weight of the water contained in tank 12, as described further below.

In the embodiment shown in FIGS. 1 to 7, shell 14 is of octagonal configuration in cross-section. Shell 14 is constructed of steel reinforced concrete, but for the purpose of clarity, the reinforcing steel has been omitted from the drawings. The exact pattern and type of steel reinforcing is considered to be conventional, and typically comprises steel reinforcing bar and welded wire mesh as required. Shell 14 includes a ground level access door 18, a ladder 20 (see FIG. 2), and inlet and outlet piping 22 for tank 12. A floor 24 is provided at ground level for supporting mechanical equipment and the like inside shell 14. The width of shell 14 across the flats is typically about twenty to thirty feet, and the height of tower 10 typically varies from about eighty to one hundred and fifty feet. Tank 12 typically contains between one hundred and fifty thousand and five hundred thousand imperial gallons of liquid, the liquid being indicated in FIG. 1 by reference numeral 26.

Referring in particular to FIGS. 1 and 4 to 6, shell 14 includes an upper distal portion 28 located substantially inside and co-axial with tank 12. Distal portion 28 defines a plurality of equi-spaced, peripheral openings 30 spaced below the top of shell 14 at the level of the tank floor. Openings 30 permit the tank floor to pass therethrough to connect or anchor tank 12 to shell 14, as will be described further below. Openings 30 also permit the free flow of water through the walls of upper distal portion 28. Openings 30 are typically about three feet in width and six feet in height to provide ample access to all portions of the inside of tank 12 during construction, and to leave openings after the tank floor is cast, which are large enough to prevent clogging by sludge. Upper distal portion 28 also includes a plurality of circulation openings 32 for permitting free flow of liquid and equalization of pressures on either side of the walls of distal portion 28. Distal portion 28 also includes a concrete roof closing portion 34, which defines a central square opening 36. Again, the concrete roof closing portion 34 is steel reinforced and is anchored to the walls of distal portion 28 using reinforcing bar anchoring, as is conventional in poured concrete construction. Opening 36 is closed by a steel cover 38, which includes a pair of access hatches 40, 42. As seen best in FIG. 1, access hatch 40 covers an access tube 44 extending vertically through tank 12 to communicate with the inside of shell 14. Access tube 44 contains a ladder 46 (see FIG. 4), which is joined to ladder 20 inside shell 14. A person may enter tank 12 by climbing ladders 20, 46 and passing through access hatches 40, 42, so that it is not necessary to provide exterior means for climbing tower 10.

As seen best in FIGS. 1 and 3, tank 12 is generally cylindrical having a generally conical, downwardly widening roof 48, and a generally conical, downwardly and inwardly disposed annular bottom wall 50. Roof 48 defines an upper central roof opening 52 which is closed by roof closing portion 34, because the upper distal portion 28 of shell 14 extends vertically through tank 12 to this upper roof opening. Roof 48 is formed of a plurality of sector shaped steel plates 54, and a plurality of inner peripheral plates 56, the latter peripheral plates 56 defining the upper central opening in roof 48. Peripheral plates 56 are strong horizontally and weak vertically and act as a type of bellows to permit a limited amount of vertical movement of roof 48 caused by expansion and contraction of the tank, and the initial loading of the tank when first filled with liquid. Peripheral plates 56 at the same time provide a significant lateral support to the tank, relieving the tank floor connection of the need to provide this function.

Figure 7:
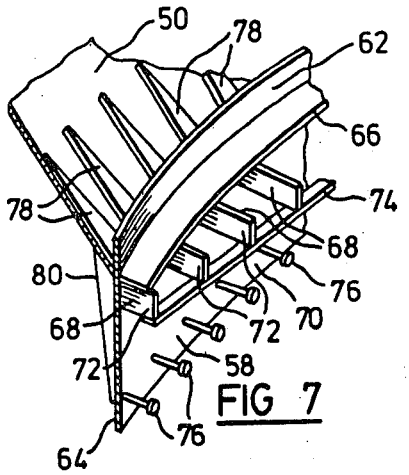
FIG. 7 is a perspective view of a segment of the tank lower skirt when viewed from the inside of the tank.
Figure 5:
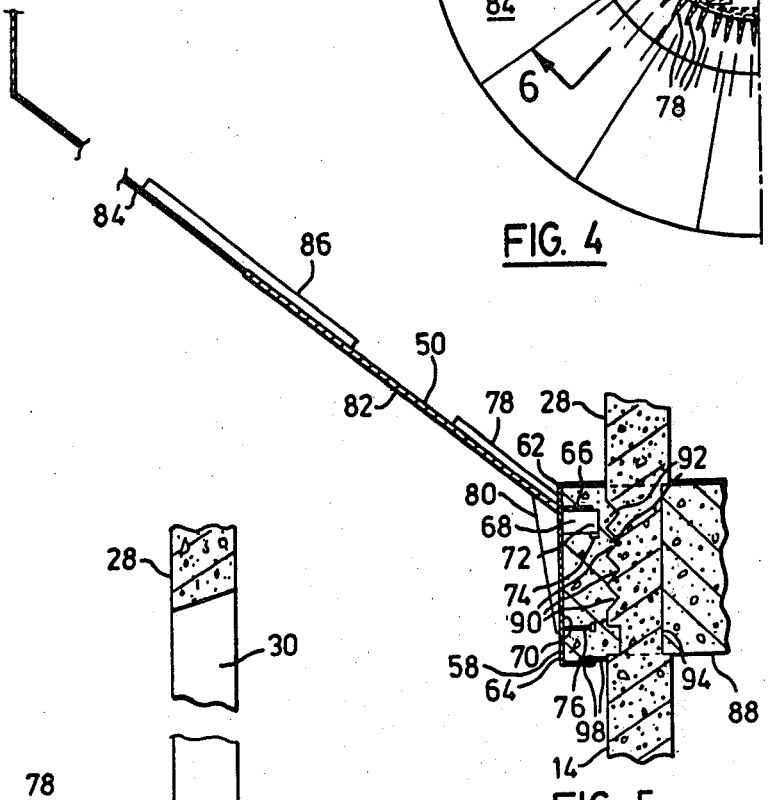
FIG. 5 is a vertical sectional view of a portion of the tower taken along lines 5—5 of FIG. 4.
Figure 6:
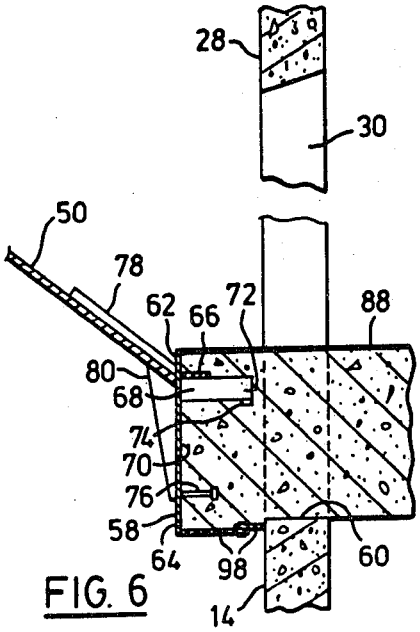
FIG. 6 is a vertical sectional view of a portion of the tower taken along lines 6—6 of FIG. 4.

Referring in particular to FIGS. 5 to 7, tank 12 includes a lower skirt 58, which defines a generally vertical opening in the bottom of tank 12 through which upper distal portion 28 of shell 14 extends. The column peripheral openings 30 are thus located adjacent to skirt 58 (the bottoms of peripheral openings 30 being indicated by reference numeral 60 in FIG. 6). Tank skirt 58 has a top peripheral edge portion 62 and a bottom peripheral edge portion 64, the downwardly and inwardly disposed annular bottom wall 50 of tank 12 being attached to the skirt adjacent to the top peripheral edge portion 62. Skirt 58 includes radially projecting anchoring means comprising an annular inwardly projecting plate 66 located adjacent to the skirt top peripheral edge portion 62. A plurality of vertical, radially inwardly disposed gussets 68 are attached to the underside of annular plate 66 and the inside surface 70 of skirt 58. Gussets 68 have lower inward corners 72, and tie-bars 74 connect lower inward corners 72. Tie-bars 74 are straight where the cross-sectional configuration of shell 14 is octagonal (FIG. 2), and consequently, the radial lengths of gussets 68 vary due to the curvature of skirt 58. The tank lower skirt anchoring means also includes a plurality of inwardly disposed radial studs 76 located adjacent to the skirt bottom peripheral edge portion 64. The combination of skirt 58, annular plate 66 and gussets 68 forms the prime structural support for tank 12. Annular plate 66 also functions as a water stop. The primary function of studs 76 is to retain lower skirt 58 in position and help prevent leaks, as described further below.

The annular bottom wall 50 of tank 12 includes a plurality of radially disposed reinforcing plates 78 attached to the skirt top peripheral edge portion 62. Reinforcing plates 78 are tapered to decrease in width as the plates extend radially outwardly. Also, a plurality of vertical outer gussets 80 are located below reinforcing plates 78 and extend downwardly over the outer surface of skirt 58. As mentioned above, tank 12 is of steel construction, and the various components are welded together using conventional welding techniques.

Figure 4:
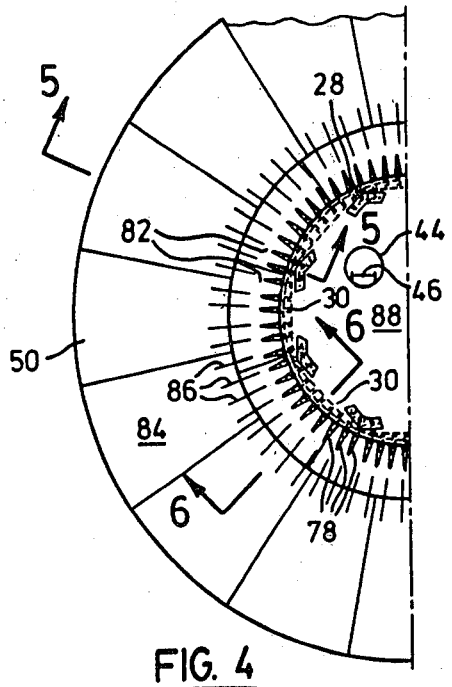
FIG. 4 is a partial plan view taken along lines 4—4 of FIG. 1.

The annular bottom wall 50 of tank 12 is formed of a plurality of inner truncated sector-like plates 82, and a plurality of outer sector-like plates 84, as seen best in FIG. 4. The annular joint between inner and outer plates 82, 84 is reinforced by radially disposed ribs 86 welded to the plates. The thickness of inner and outer plates 82, 84 depends upon the tank size, but inner plates 82 are generally thicker than outer plates 84 in order to control the transition from rigid shell 14 to the relatively flexible tank 12. This difference in plate thickness, together with the tapered reinforcing plates 78, results in an annular bottom wall 50 of increasing strength in a radially inward direction toward lower skirt 58. It will be appreciated by those skilled in the art that higher strength is required in bottom wall 50 adjacent to skirt 58 due to high bending and compressive stresses, than is required remote from skirt 58 where hoop stress and a minimum amount of compressive stress occurs in bottom wall 50.

Tank 12 also includes a continuous concrete tank floor 88, which extends through the shell peripheral openings 30 to skirt 58 to sealingly close the lower vertical opening in tank 12. Again, tank floor 88 includes conventional reinforcing steel (not shown) appropriate for the load which floor 88 must support. As seen best in FIGS. 5 and 6, concrete floor 88 engages the various anchoring components of skirt 58 to retain tank 12 in position on shell 14. As seen best in FIG. 5 the shell upper distal portion 28 includes circumferential keying grooves 90, which engage mating ribs 92 formed in tank floor 88. These grooves and ribs help to transmit the loading forces from tank floor 88 to shell 14. Also, an inner groove 94 (see FIG. 5) is formed on the inside surface of upper distal portion 28 of shell 14, so that the concrete floor is keyed to shell 14 on the inside as well.

In constructing tower 10, foundation 16 is first laid or constructed using conventional design and construction techniques, as mentioned above. Foundation 16 is located below ground level 96 a distance dictated by the soil conditions, as will be appreciated by those skilled in the art. Once the foundation is laid, shell 14 is constructed to its full height, including upper distal portion 28. It is preferred that a jump forming technique be used for pouring the concrete of shell 14. However, a slip-forming technique could also be used if desired. It will be appreciated, that some type of tower crane and scaffolding is required for supporting the forms and pouring the concrete. Roof closing portion 34 is also poured to complete upper distal portion 28, and thus the concrete construction of shell 14.

Tank 12 is fabricated at ground level 96 around the base of shell 14, using a suitable jig or fixture to support the various steel plate members until they are welded together. The entire tank 12 is constructed at the base of shell 14, except for the tank roof inner peripheral plates 56, which are installed later, as described below. The inwardly disposed surfaces of lower skirt 58 (including the anchoring means) are metallized prior to fabrication to prevent corrosion. The metallizing process typically involves the flame spraying of zinc on the metal surfaces to form a zinc coating approximately 0.008 inches (0.2 mm) in thickness. The remaining surfaces of tank 12 are painted in a conventional manner.

The next step in the construction of tower 10 is to suitably brace the fabricated tank 12 and hoist same into position at the upper distal portion 28 of shell 14, so that the upper central roof opening 52 of tank 12 is adjacent to the top surface of the concrete roof closing portion 34. At this point, lower skirt 58 is adjacent to peripheral openings 30 and keying grooves 90 of the shell upper distal portion, as seen best in FIGS. 5 and 6. It will be appreciated that the existance of shell 14 facilitates the positioning and correct alignment of tank 12 on shell 14. After tank 12 is aligned, suitable forms are then positioned for the pouring of tank floor 88. In this connection, adjustable steel plate 98 are attached to the skirt bottom peripheral edge portion 64 to close the space between the skirt and shell 14, and eliminate the need for form work on the outside of shell 14. Access tube 44 is then positioned inside tank 12 and tank floor 88 is poured.

Prior to pouring the concrete of floor 88, the inside surfaces of lower skirt 58 and the botom surfaces of access tube 44, which have been metallized, are coated with an epoxy resin or bonding agent of a type that will bond to concrete cast against it. This epoxy resin at the interface of the skirt and tank floor seals the metallizing and helps to bond the skirt to the tank floor to prevent leaks. After the concrete is cast, but before it has hardened, the peripheral edge portion of the concrete tank floor 88 is bevelled adjacent to the skirt top peripheral edge portion 62 to form a groove. This groove is then filled with epoxy resin or other sealant to caulk the joint between the tank floor and skirt 58. Finally, after the concrete of floor 88 has hardened, the inside surface of the tank floor and adjacent portions of the tank skirt and shell distal portion are coated with a surfacing material such as latex mortar or a polymer-cement material to further waterproof the tank floor. A suitable polymer-cement material for this purpose is marketed under the name TAPECRETE, which is a trade mark owned by FRC Composites Limited of Don Mills, Ontario, Canada. The floor thus completed, the upper peripheral plates 56 of the tank roof are then installed to complete the tank roof.

Referring next to FIGS. 8 and 9 another embodiment of elevated storage tank or tower construction is generally indicated by reference numeral 100. Tower 100 is similar to tower 10 described above, except for the connection between tank 12' and tank floor 88'. In this embodiment, the skirt top peripheral edge portion 62' and the annular plate 66' are integrally formed of steel angle stock. An annular downwardly and outwardly disposed seat plate 102 is located adjacent to top peripheral edge portion 62' (attached at the vertex of the angle stock forming edge portion 62' and annular plate 66'). Tank annular bottom wall 50' is attached circumferentially to seat plate 102. Seat plate 102 is disposed generally perpendicular to bottom wall 50'. Vertical gussets 68' are welded to the underside of annular plate 66' and the respective inside surfaces of seat plate 102 and skirt 58'. Annular plate 66', gussets 68' and skirt 58' contain or restrain the concrete of tank floor 88' and thus enhance the load carrying capacity of the tank floor. These components also form the prime structural support and distribute the load of tank 12'. Again, annular plate 66' functions as a water stop.

It will be noted that tower 100, unlike tower 10 described above, does not have reinforcing plates 78 or outer gussets 80. Seat plate 102 of tower 100 provides sufficient flexibility and load distribution capability to accommodate the stress transition from rigid shell 14' or tank floor 18' to the relatively flexible tank bottom wall 50'.

Referring lastly to FIG. 10, another embodiment of cylindrical shell or column is represented by reference numeral 104. Shell 104 is circular in cross-section, rather than octagonal as in the case of shell 14. Shell 104 could be used with either tower 10 or tower 100 described above. A shell with a circular cross-section may be preferred for ease of construction. Of course, the circular cross-section would extend over the full height of the shell, and suitable modifications would be made to the mating components of tanks 12, 12'.

Having described preferred embodiments of the invention, it will be appreciated that various modifications may be made to the structure described. For example, shell 14 could be of other cross-sectional configuration than octagonal or circular. For example, hexagonal, square, or even irregularly shaped columns could be constructed if desired.

In larger tanks, it may be desirable to make tank floor 88 convex in vertical cross-section for increased strength. In order to simplify the form work, roof closing portion 34 could also be convex, so that the same forms could be used to pour floor 88 as roof closing portion 34.

The tank annular bottom wall 50 could be formed of a single, outwardly narrowing tapered solid steel plate section, rather than using tapered reinforcing plates 78 and ribs 86. Ribs 86 could also be eliminated from the structure described. However, a tapered solid steel plate is believed to be more expensive to construct. Also, some variation could be made to the radially projecting anchoring means of lower skirt 58. Also, the upper distal portion of shell 14 does not have to extend to the roof of tank 12. In fact, the shell upper distal portion could be replaced by an enlarged access tube 44 of sufficient stiffness and strength to provide the lateral support for the top of tank 12. Finally, other roof structures could be employed, if desired.

In conclusion, the tower of the present invention is relatively simple and inexpensive to construct, and yet capable of storing large volumes of liquids. The possibility of leakage is minimized and the life of the tower is maximized due to the tower's construction. The tank is highly resistant to leakage caused by deformation of the tank components under load, or due to expansion or contraction caused by temperature variations. It will be appreciated that the conical tank bottom wall and the anchoring means employed in this invention provide a water-tight seal that is proportional in effectiveness to the tank load. Further, the storage tank is highly resistant to corrosion at the interface of the steel tank surfaces and the concrete tank floor. This is particularly important because this area is not normally maintainable, unlike the remainder of the elevated storage tank of this invention.

What we claim are:

1. A tower for the elevated storage of liquids, such as water, the tower comprising:

an upright, hollow, cylindrical shell adapted to be anchored to a supporting base foundation, the shell having an upper distal portion defining a plurality of peripheral openings spaced below the top of the shell;

a tank mounted at the upper distal portion of the shell, the tank having a lower skirt defining a generally vertical opening, the shell distal portion extending through said opening so that the shell peripheral openings are adjacent to the skirt, the skirt including radially, inwardly projecting anchoring means; and a continuous tank floor extending through the shell peripheral openings to the skirt to sealingly close said tank vertical opening, the floor engaging said anchoring means to support and retain the tank in position on the shell.

2. A tower as claimed in claim 1 wherein the shell and tank floor are formed of reinforced concrete, and the remainder of the tank is formed of steel.

3. A tower as claimed in claim 2 wherein the tank has a roof defining an upper central roof opening, and wherein the shell distal portion extends vertically through the tank to said upper opening, the distal portion including a roof closing portion closing said upper central roof opening.

4. A tower as claimed in claim 2 wherein the tank skirt has top and bottom peripheral edge portions, the tank having a downwardly and inwardly disposed annular bottom wall attached to the skirt adjacent to said top peripheral edge portion.

5. A tower as claimed in claim 4 wherein the tank annular bottom wall includes a plurality of radially disposed reinforcing plates attached to the skirt top peripheral edge portion, the reinforcing plates being tapered to decrease in width as the plates extend radially outwardly.

6. A tower as claimed in claim 5 and further comprising a plurality of vertical outer gussets, said gussets being located below the tapered radial reinforcing plates and extending downwardly over the outer surface of the skirt.

7. A tower as claimed in claim 4 wherein the tank skirt includes an annular downwardly and outwardly disposed seat plate located adjacent to the top peripheral edge portion, the tank annular bottom wall being attached circumferentially to the seat plate.

8. A tower as claimed in claim 7 wherein said radially projecting anchoring means include an annular inwardly projecting plate attached to the skirt adjacent to the skirt top peripheral edge portion and the seat plate.

9. A tower as claimed in claim 8 wherein said radially projecting anchoring means further include a plurality of vertical gussets located under said annular plate.

10. A tower as claimed in claim 4 wherein said radially projecting anchoring means include an annular inwardly projecting plate attached to the skirt top peripheral edge portion.

11. A tower as claimed in claim 10 wherein said radially projecting anchoring means further include a plurality of vertical gussets located under said annular plate, the gussets having lower inward corners, and tie-bars connecting said lower inward corners.

12. A tower as claimed in claim 4 wherein said radially projecting anchoring means include a plurality of inwardly disposed radial studs located adjacent to the skirt bottom peripheral edge portion.

13. A tower as claimed in claim 1 wherein the shell distal portion defines circumferential keying grooves, the tank floor defining mating ribs for locating engagement in said keying grooves.

14. A tower as claimed in claim 1 wherein the column distal portion defines a plurality of circulation openings located inside the tank for free circulation of fluid therethrough.

15. A tower as claimed in claim 2 wherein said inwardly disposed surface of the skirt is metallized to prevent corrosion.

16. A tower as claimed in claim 2 wherein epoxy resin is located at the interface of the skirt and tank floor, thereby bonding the skirt to the tank floor.

17. A tower as claimed in claim 2 wherein the tank floor and adjacent portions of the tank skirt and shell distal portion inside the tank are coated with surfacing material to further waterproof the tank floor.

18. A tower as claimed in claim 3 wherein the tank roof includes a plurality of inner peripheral plate members defining said upper central opening, the plate members forming bellows to permit expansion and contraction of the tank while providing lateral support for the tank.

19. A tower as claimed in claim 8 wherein said radially projecting anchoring means include a plurality of inwardly disposed radial studs located adjacent to the skirt bottom peripheral edge portion.

20. A power as claimed in claim 2 wherein the shell distal portion defines circumferential keying grooves, the tank floor defining mating ribs for locating engagement in said keying grooves.

21. A tower as claimed in claim 2 wherein the column distal portion defines a plurality of circulation openings located inside the tank for free circulation of fluid therethrough.

22. A tower as claimed in claim 8 wherein said inwardly disposed surface of the skirt is metallized to prevent corrosion.

23. A tower as claimed in claim 22 wherein epoxy resin is located at the interface of the skirt and tank floor, thereby bonding the skirt to the tank floor.

24. A tower as claimed in claim 23 wherein the tank floor and adjacent portions of the tank skirt and shell distal portion inside the tank are coated with surfacing material to further waterproof the tank floor.

* * * * *